US006261331B1

(12) United States Patent
Fleurier et al.

(10) Patent No.: US 6,261,331 B1
(45) Date of Patent: Jul. 17, 2001

(54) DEVICE FOR CONNECTING A VACUUM CLEANER DUST BAG

(75) Inventors: Vincent Fleurier, Vernon; Roland Dubos, Richeville; Patrick Morin, Heubecourt, all of (FR)

(73) Assignee: SEB S.A., Ecully (FR)

( * ) Notice: Subject to any disclaimer, the term of this patent is extended or adjusted under 35 U.S.C. 154(b) by 0 days.

(21) Appl. No.: 09/341,236

(22) PCT Filed: Nov. 13, 1998

(86) PCT No.: PCT/FR98/02430

§ 371 Date: Jul. 13, 1999

§ 102(e) Date: Jul. 13, 1999

(87) PCT Pub. No.: WO99/25236

PCT Pub. Date: May 27, 1999

(30) Foreign Application Priority Data

Nov. 13, 1997 (FR) ..... 97 14467

(51) Int. Cl.[7] ..... B01D 46/00

(52) U.S. Cl. ..... 55/374; 15/347; 15/DIG. 8; 55/378; 55/507; 55/DIG. 2; 55/DIG. 3

(58) Field of Search ..... 15/347, DIG. 8; 55/373–378, 502, 507, DIG. 2, DIG. 3

(56) References Cited

U.S. PATENT DOCUMENTS

| | | | | |
|---|---|---|---|---|
| 2,975,862 | * | 3/1961 | Goldberg | 55/376 |
| 3,150,405 | * | 9/1964 | Tissler | 55/374 X |
| 3,242,654 | * | 3/1966 | Kornstien et al. | 55/376 |
| 3,683,599 | * | 8/1972 | Malz | 55/378 X |
| 4,364,757 | * | 12/1982 | Leonatti | 55/377 X |
| 4,738,697 | * | 4/1988 | Westergren | 55/376 |
| 4,877,432 | * | 10/1989 | Lackner | 55/375 |
| 5,092,915 | * | 3/1992 | Lackner | 55/375 |
| 5,221,303 | * | 6/1993 | Gühne et al. | 55/373 X |
| 5,464,460 | * | 11/1995 | Bosses | 55/374 |
| 5,725,619 | * | 3/1998 | Brule et al | 55/DIG. 3 |
| 5,792,224 | * | 8/1998 | Fu et al. | 55/375 |
| 6,071,322 | * | 6/2000 | Hulthén | 55/DIG. 2 |
| 6,086,649 | * | 7/2000 | Tuvin et al. | 55/377 X |

FOREIGN PATENT DOCUMENTS

| | | |
|---|---|---|
| 32 34 837 | 3/1984 | (DE) . |
| 34 04 058 | 8/1985 | (DE) . |
| 626 150 | 11/1994 | (EP) . |
| 92 13479 | 8/1992 | (WO) . |

* cited by examiner

*Primary Examiner*—Robert H. Spitzer
(74) *Attorney, Agent, or Firm*—Browdy and Neimark

(57) ABSTRACT

A device for connecting a dust bag, the device having a mounting flange (1) and a ring (21) capable of being fixed, matching, one to a vacuum cleaner frame or to a removable vacuum cleaner support or to a linerboard, and the other to the dust bag via one of their two faces, the flange (1) and ring (21) being provided with additional matching elements for being mutually maintained by their free face, and with at least a visual mark (4,24) to facilitate their connection. The invention is characterized in that the diameter of the device is twice as much as the length of the assembled device, when the ring (21) and the flange (1) are arranged one on the other. Advantageously, the flange (1) and the ring (32) have a non-planar surface at their free face, resulting from the difference in height of the two parts, for guiding one of the parts onto the other when they are being connected.

20 Claims, 7 Drawing Sheets

DEVICE FOR CONNECTING A VACUUM CLEANER DUST BAG

This application is the national phase of international application PCT/FR98/02430 filed Nov. 13, 1998 which designated the U.S.

1. Technical Field

The invention concerns vacuum cleaner dust bags, and more particularly a device permitting connection of a dust bag to a vacuum cleaner housing.

2. Prior Art

Vacuum cleaners are generally equipped with a bag for storing waste material, at least temporarily. The bag permits a simple handling of this waste. Attachment of the bag to the interior of the vacuum cleaner is generally effected with the aid of a rigid part, an integrating part of the bag, which permits the inlet opening of the bag to be maintained in the desired position. In general, the rigid part has a substantially central opening, which permits introduction of the suction tube. A seal between the interior of the bag and the suction tube on the one hand and the exterior of the bag and the dust reservoir in which the bag is placed on the other hand is achieved. The rigid part can be introduced into channels, which maintain it in place.

There are known connection systems for vacuum cleaner bags comprising a bag support advantageously furnished with a handle permitting this support to be extracted from the housing of the vacuum cleaner, the bag comprising a rigid part permitting its connection to the support. The system for assembling the bag to the support can be constituted by a channel, as in the document EP 626150 where a means for unlocking attachment means facilitates the ejection of the bag from the support. For hygienic reasons, innovation efforts have essentially been directed to systems permitting the bag to be separated from the support without the user being in contact with the bag filled with dust. In contrast, means for connecting a new bag can be improved. It is in effect rather difficult, in certain cases, to connect the bag to its support through lack of visibility due to the presence of the envelope of the bag which partially hides the connection during assembly of the bag onto its support.

SUMMARY OF THE INVENTION

One of the objects of the invention is to overcome the drawbacks cited above by using a connection system, which is practical, reliable and simple to use.

Another object of the invention is to limit the risks of degradation of the connection part connected with the vacuum cleaner by reducing the flexure forces capable of being applied onto this connection.

Another object of the invention is to furnish, for any type of vacuum cleaner, a system for connecting a dust bag, and this, regardless of the vacuum cleaner model. It is in effect of interest to note that the useful life of a vacuum cleaner can exceed the time during which the vacuum cleaner is being marketed. Thus, the user can find himself in a situation where he no longer finds a bag adapted to his vacuum cleaner model. The present invention also permits this problem to be remedied by providing a ready-to-mount connection permitting replacement of its existing connection system by an up to date system.

The present invention does not however aim solely at obsolete vacuum cleaners since this connection system can be installed on a large variety of vacuum cleaner models.

Thus, these goals are achieved by a device for connecting a dust bag comprising a flange and a ring capable of each being fixed, in a complementary manner, one to a vacuum cleaner housing or to a removable vacuum cleaner support or to a linerboard, and the other to the dust bag via one of their two faces, said flange and ring having complementary means for mutual maintenance by their free face, as well as with at least one visual mark to facilitate their connection, characterized in that the diameter of the device is greater than twice the length of the assembled device, when the ring and the flange are arranged on one another.

This connection system thus comprises two parts, the first having to be fixed either directly or by the intermediary of a linerboard, on the housing or on a removable support of the vacuum cleaner, while the second is connected to the dust bag. The originality of the invention resides in the short length of this connection as well as in the existence of means which permit the part connected to the bag to be guided toward the part connected to the vacuum cleaner. This guiding comprises a visual guiding as well as a guiding by sliding of one part on the other after their contact.

This dimensional relation permits a reduction in the flexure forces likely to appear at the level of fastening during utilization of this connection, by a replacement of the bag, for example. The risks of deterioration of the connection are thus reduced.

Preferably, the flange (or the ring) capable of being fixed to one part of a vacuum cleaner housing, or to one part of a removable vacuum cleaner support, or to a linerboard, comprises, correspondingly, a peripheral contact crown at its opening.

This crown permits various possibilities of arrangement and of attachment of the vacuum cleaner, while offering a substantial contact surface. In effect, one of the characteristics of this crown is to present a surface area capable of being in contact with a part of a vacuum cleaner housing, or a part of a removable vacuum cleaner support, or a linerboard, greater than 8 $cm^2$.

According to a first variant, the fixing means of the crown for peripheral contact with the opening of the flange (or of the ring) on the part of the vacuum cleaner housing, or on the part of the removable vacuum cleaner support, or on the linerboard, is of cementing type, permitting a simple, inexpensive and strong connection to be offered, particularly as a result of the substantial contact surface that it presents.

According to a second variant, the crown for peripheral contact with the opening of the flange (or of the ring) has a peripheral flat radial part of small thickness having two opposed free faces in order to permit its attachment by stapling of this peripheral surface on the part of the vacuum cleaner housing, or on the part of a removable vacuum cleaner support, or on the linerboard.

This second mode of attachment is strong and economical.

According to a third variant, the means for fastening the peripheral contact crown to the opening of the flange (or of the ring) comprises a tubular wall oriented substantially coaxially with the contact crown, prolonging said opening from the side opposed to the connection, said tubular wall comprising at its free end a bulge oriented from the exterior side of the wall, in such a manner as to be able to cooperate with the internal wall of a disk serving as a counter-piece when the flange (or the ring) is inserted, by the tubular wall, into the opening of the wall of the vacuum cleaner housing, or of one part of a removable vacuum cleaner support, or of a linerboard.

This arrangement, more complex than the preceding ones, has the advantage of being able to be reversible, permitting easy withdrawal of the ring or of the flange held by the counter-piece, while permitting a reliable connection.

Preferably, the ring (or the flange), capable of being fixed to the vacuum cleaner bag, comprises, correspondingly, a peripheral fastening contact prong at its opening.

This peripheral crown permits assurance of a seal between the bag and the rigid part permitting attachment of the bag upon connection.

This crown advantageously has a substantial contact surface with the vacuum cleaner bag, greater than 5 $cm^2$, in order to assure a good holding of the bag, capable of being filled with waste having a total mass that can reach several kg.

According to a first variant, the fastening means of the peripheral contact crown to the opening of the ring (or of the flange) on the dust bag, is of cementing type, in order to present an attachment which is simple to use and inexpensive.

According to a second variant, the fastening means for the peripheral contact crown at the opening of the ring (or of the flange) on the dust bag, is of the ultrasonic welding type. This technique permits a strong and intimate bond between the bag and the ring or the flange.

Preferably, the flange and the ring have a non-planar surface at the level of their free face facing one another, obtained by variation of the height of the two pieces, in order to guide one of the pieces on the other at the moment of their connection.

This particularity permits one of the pieces to approach the other in an approximative manner and to terminate the connection movement by a blind guiding by the set of complementary ramps of the facing surfaces of the two attachment elements. The connection is thus facilitated.

Advantageously, visual marks of the flange and of the ring are at least a lateral protrusion formed in each of the two pieces.

These lateral protrusions immediately permit the user to bring the first piece toward the second in a configuration close to the connection configuration.

According to an advantageous characteristic of this latter embodiment, the connection device comprises, on the ring and on the flange, at least two protrusions disposed in a symmetrical manner on each of the parts, which facilitates a connection of the two parts since the connection then has a symmetry of an order equal to the number of protrusions.

According to one of the embodiments previously cited, these zones of small height are situated:

on one of the two parts at the level of the lateral protrusions, between the lateral protrusions on the other part, this configuration permitting an optimized and easy guiding of the pieces on one another.

Advantageously, for a better visualization of the connection, the flange and the ring are provided with the same number of protrusions.

According to an additional fabrication characteristic, the free surface of one of the two parts comprises a profiled contour in the form of a U presenting a sealing lip comprising an internal boss and a guiding lip, these two lips delimiting a groove 31 capable of receiving, in a complementary manner, the profile of the contour of the free surface of the other part in order to achieve a sealed assembly.

According to a first embodiment of the fastening of the two parts, the complementary means for reciprocal holding of the ring and of the flange are constituted by at least one clip formed on one of the two parts, the second part having at least a complementary ring capable of cooperating with the clip in order to provide the maintenance device.

In a second form of construction of the fastening of the two parts, the complementary means for reciprocal maintenance of the ring and of the flange are constituted:

by a U profile formed in one of the two parts and presenting a guide lip and a sealing lip defining a groove inclined along a certain angle, the sealing lip having a boss, by a profile complementary to this groove with a contour formed in the second part, in such a manner that the mutual maintenance of the two parts is achieved by elastic deformation of the sealing lip during engagement of the contour in the groove.

BRIEF DESCRIPTION OF THE DRAWINGS

The present invention will be better understood with the aid of the description which will follows, given by way of nonlimiting example, with reference to the attached realistic figures, among which.

The figures presented are practical views, to a scale particularly of 1.2/1 for FIGS. 1–5 of the connection device.

BEST MANNER OF PRACTICING THE INVENTION

Figure 1:
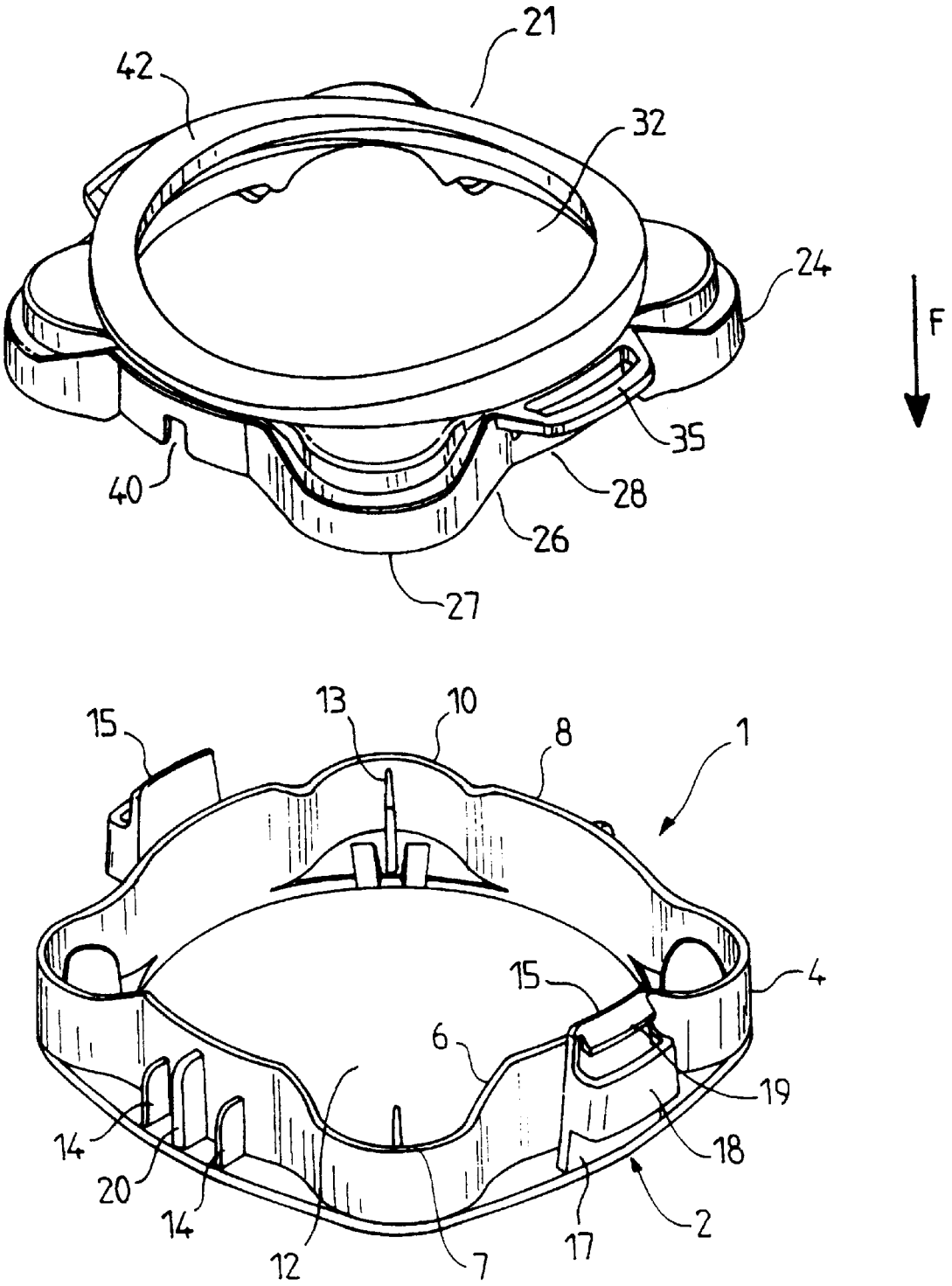
FIG. 1 presents the two parts of the connection device in a perspective view.

FIG. 1 shows a complete connection system which is composed of a flange 1 and a ring 21 made of plastic material. In the proposed example, by way of illustration of the invention, flange 1 is intended to be connected to the housing or to a removable support of the vacuum cleaner, by the intermediary of a linerboard 54 (cf. FIG. 8) on which it is cemented, while ring 21 is intended to be connected to the dust bag. Advantageously, it can be provided to integrate a linerboard with the flange in order to form only a single piece, which reduces the number of pieces of the device and increases the quality of the connection of flange 1 on the vacuum cleaner.

Figure 8:
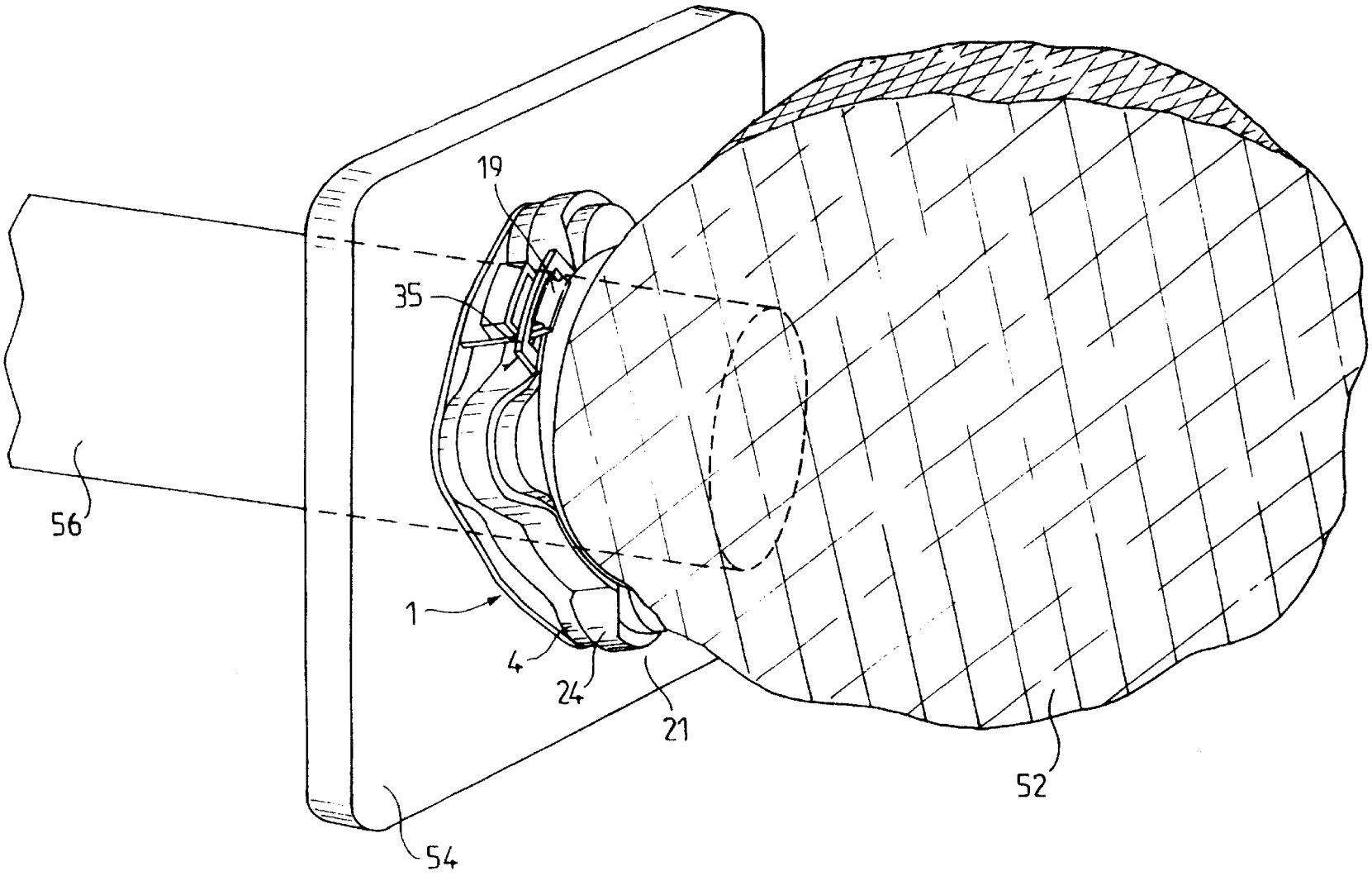
FIG. 8 presents a vacuum cleaner bag connected to a linerboard.

One of the particularities of this connection, particularly clearly visible on FIG. 8, is the relation between its average diameter and its length. In effect, as one can note on FIGS. 2 to 5, this ratio is greater than two, which signifies that the length of the connection is clearly smaller than its diameter.

This particularity presents numerous advantages. The first is to reduce the flexure forces during manipulation of a bag equipped with one of the connection parts on the second.

Moreover, this small connection length permits said connection to be disposed in the majority of vacuum cleaners, its bulk being substantially reduced.

Finally, the risks of degradation by vibrations transmitted by the appliance during its operation are reduced, these vibrations being reflected more when the connection is long than when it is short.

The configuration presented can be entirely reversed without departing from the framework of the present invention. In effect, these two parts 1, 21 each posess a surface intended to be in contact with the bag or connected with the vacuum cleaner housing, their second face being intended for their mutual connection. Thus, the particular characteristic of the face intended to be connected to the bag can be situated on the ring or the flange, like the face intended to be connected to the housing or to a removable support of the vacuum cleaner.

Figure 2:
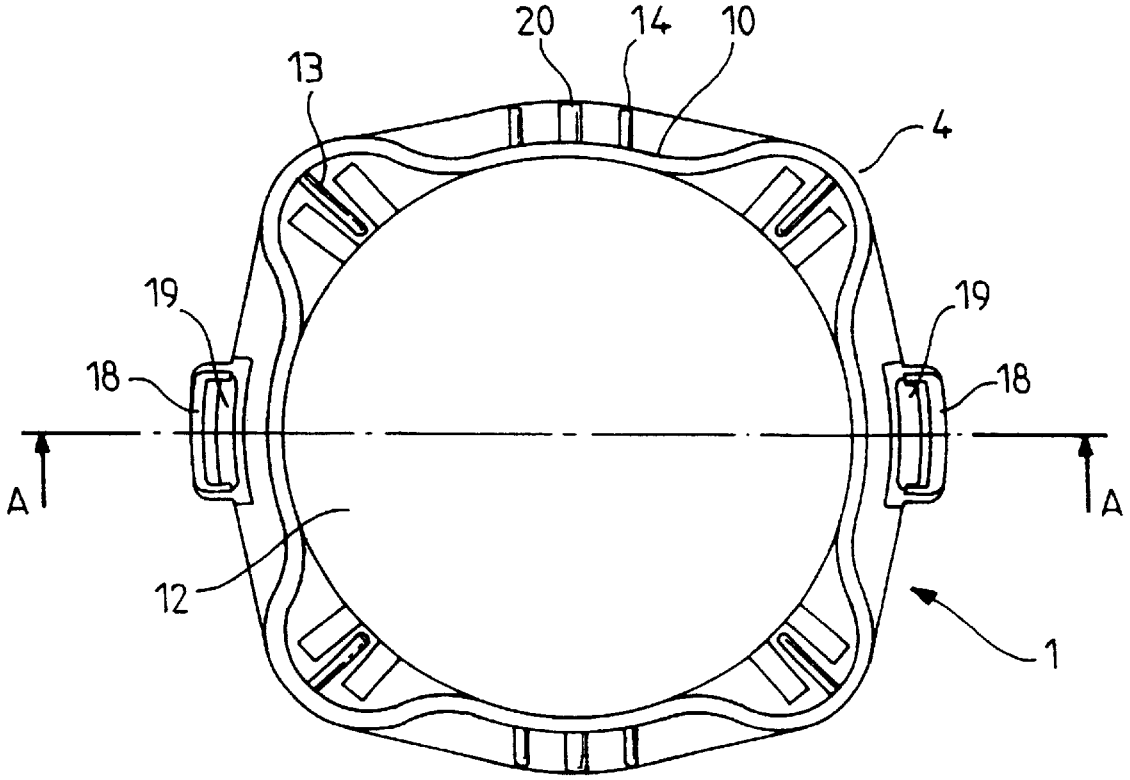
FIG. 2 is an elevational view of the flange.

Flange 1 is a part having a circular appearance, as indicated in FIG. 2, being provided with an outlet opening 12 at a center for the passage of a suction tube or pipe. With respect to its general circular form, this flange 1 is provided with protrusions 4 which are advantageously lateral. These protrusions permit a visual reference for connection of the two parts, since these protrusions are equally disposed on ring 21. These distinctive signs can take various forms, the principle being to interrupt the harmony of the piece in order that the user can clearly identify how the parts should be brought together in order to be connected.

Thus, flange 1 is provided with a contour 10 on one of its faces which is sinuous and which is spaced from a circle by the intermediary of four protrusions 4 with which the flange is provided. This number is not limiting, at least one reference sign is needed. However, it is not necessary to go beyond four or five reference signs, since the expected effect is suppressed by the effect of number.

Advantageously, when these reference signs are multiples, they are disposed regularly in the part, in a manner to obtain a connection having a symmetry. Thus, in the proposed example, the symmetry is of the order of 4, which signifies that regardless of the manner in which the user approaches the ring 21 to flange 1, it would not be necessary to effectuate more than one-eighth of a turn in order to connect the two parts.

Figure 3:
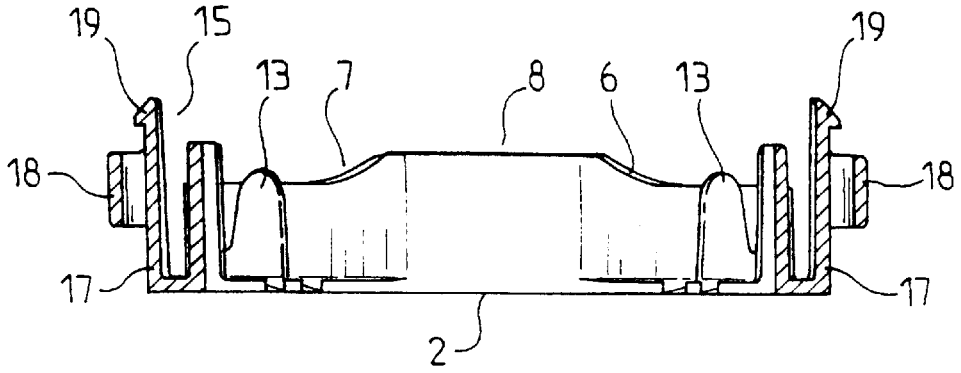
FIG. 3 is a view of the flange along the section A—A of FIG. 2.

Moreover, the contour 10 is not flat, flange 1 having variations in its height, as is visible on FIGS. 1 and 3. Thus, this flange 1 has zones of small height 7 and higher zones 8, these zones being connected together by slopes 6. In order to retain the connection symmetry of the parts, zones 7, 8 are distributed in a symmetrical manner, in association with protrusions 4 of the part. Thus, zones 7 of small height are accentuated at the level of protrusions 4, higher zones 8 being situated between protrusions 4 or on the entire periphery of the part except for the protrusion if there is only one of this latter. These differences in height and the resulting slopes 6 permit an easier guiding of the two parts 1, 21 when they are in contact with one another, as will be described in detail subsequently.

The described configuration can be reversed, these zones of small height 7 being situated between protrusions 4.

Flange 1 comprises in addition internal mechanical reinforcement 13 situated in protrusions 4 as well as external mechanical reinforcements 14 situated on the periphery of flange 1, between protrusions 4, at the level of zones 8. An abutment 20 permits, with reinforcements 14, to constitute other visual indexing marks, which facilitates the connection of the two parts 1, 21. Abutment 20 can be viewed through a notch 40 in ring 21.

Moreover, the flange and the ring each have a peripheral contact crown 2, 42 at their central opening. By crown there is intended a usually flat surface which can be rounded, but is continuous on its entire periphery permitting provision of a contact surface and a sealed connection, for example for the ring with the bag, or for the flange with the linerboard.

Contact crown 2 is intended to come in contact with the housing or the removable support of the vacuum cleaner, in order to guarantee a secure and solid fastening of flange 1 on the vacuum cleaner housing, for example, by cementing on a linerboard, itself fixed on the housing or on the support.

In order to ensure a good adherence of the flange on the linerboard or a part of the vacuum cleaner housing, its contact surface area is at least 8 $cm^2$, and preferably comprised between 10 and 30 $cm^2$. In the example proposed, the crown has an internal diameter of 6.1 cm and an external diameter of 7.4 cm, the surface area under each protrusion representing around 1 $cm^2$. This contact surface is sufficiently large to ensure a good maintenance of the flange on the vacuum cleaner or the linerboard, while avoiding having a bulky connection device, as is clearly visible on the attached figures.

Figure 4:
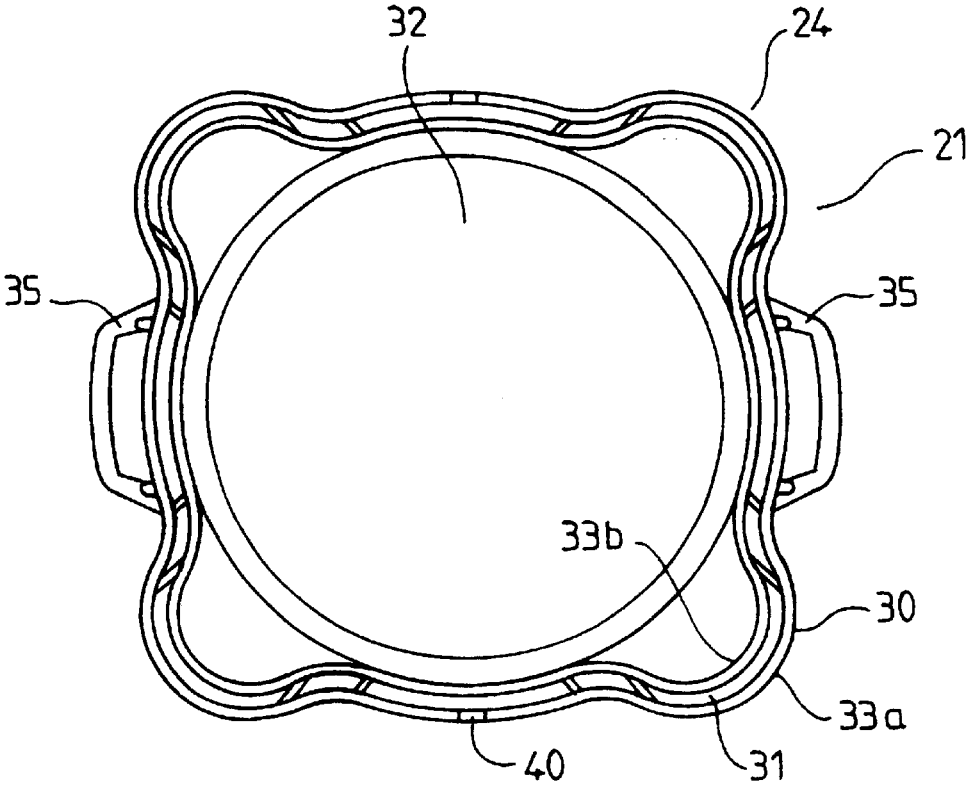
FIG. 4 is an elevational view of the interior face of the ring.
Figure 5:
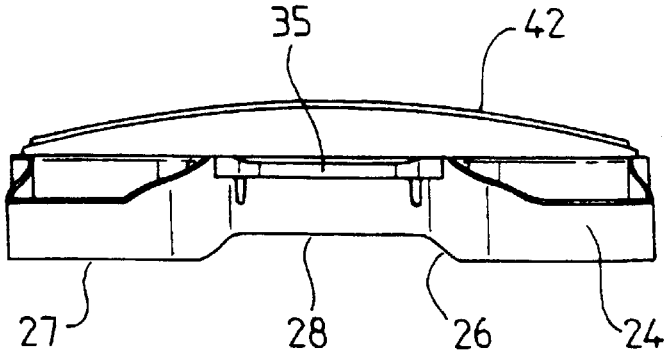
FIG. 5 is a profile view of the ring.

Ring 21, shown in detail in FIGS. 1, 4 and 5, has a form complementary to flange 1. Thus, this ring 21 comprises a central opening 32 for the passage of a suction tube or pipe, protrusion 24 distributed in a manner similar to the disposition of protrusions 4 numeral of flange 1.

According to the invention, the height of this piece is not constant, the face intended for connection on flange 1 comprising zones 28 of small height connected to zones 27 of greater height by slopes 26 with a disposition inverse to the disposition established on flange 1.

Thus, in the example shown, zones 28 of small height are situated between protrusions 24 and ring 21, the zones 7 of small height of flange 1 being situated at the level of these protrusions 4. In an advantageous manner, slopes 6, 26 are identical, in a manner to achieve an adjustment of the two parts 1, 21 by the complementarity of the parts at the level of their contact surface. The effect of sliding of the two parts on one another is thus reinforced.

According to one of the embodiments, these two parts 1, 21 fit into one another. Thus, contour 10 of flange 1 is a solid form, while contour 30 of ring 21 has a U-shaped profile, characterized by its groove 31. FIGS. 2 and 4 have been artificially modified to bring out this particularity, and particularly groove 31, by darkening all of the profiles of contours 10, 30.

Figure 7:
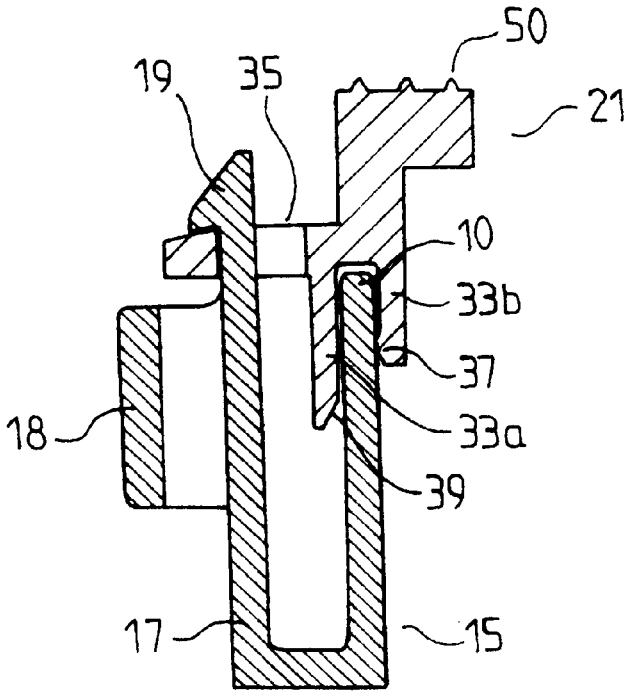
FIG. 7 is a variant of the device from maintaining the two parts, in a cross-sectional view analogous to the previous figure.

This groove 31 is capable of receiving, in a complementary manner, the solid profile of contour 10 of flange 1, thus creating a connection which is sealed against dust. In effect, according to a first embodiment, illustrated in FIG. 7, which presents a partial cross-sectional view of the two parts 1, 21 according to line A—A of FIG. 2, the U-shaped profile of ring 21 is produced by two lips, a guide lip 33*a* and a sealing lip 33*b* having a boss 37. At the time of connection, contour 10 is engaged between lips 33*a*, 33*b* guided by chamfer 39 of guide lip 33*a*, lip 33*b* being in sealing relation on contour 10 by its boss 37.

The connection means between ring 21 and flange 1, according to this first embodiment, can be associated with one or the other of these two parts. According to a first variant, one side of one of the two parts can come to engage into a recess of the other, then fold over on the other, the final connection being achieved for example by a device with at least one clip and at least one maintenance ring.

In a second variant, the connection means are constituted by a device having two clips and maintenance rings placed on one and the other of the parts, as shown in the suggested example where two fixation clips 15 are disposed symmetrically on flange 1. These clips 15 can be parts connected, or, as shown, an extension 17 of flange 1 obtained in its structure during development of the part. These clips 15 comprise a hook 19 as well as a releasing organ 18. The symmetry of the connection is then lowered to a symmetry of the order 2. Ring 21 is provided with a maintenance ring 35 capable of cooperating with hook 19 in order to support flange 1.

According to this embodiment, in an economical version, contour 30 of ring 21 does not have a U-shaped profile, but presents a profile substantially identical to the profile of contour 10 of flange 1 in a scale ratio permitting the two contours 10 and 30 to be adjusted to one another, profile 10 being able to be situated at the exterior or, preferably, at the interior of profile 30. This allows, to a certain extent, elimination of one of the lips 33*a* or 33*b* of flange 1. The arrangement of clips maintaining the 2 parts, the partial covering of the two contours provides insurance of a relatively good seal at the level of the connection of the two parts of the device.

Figure 6:
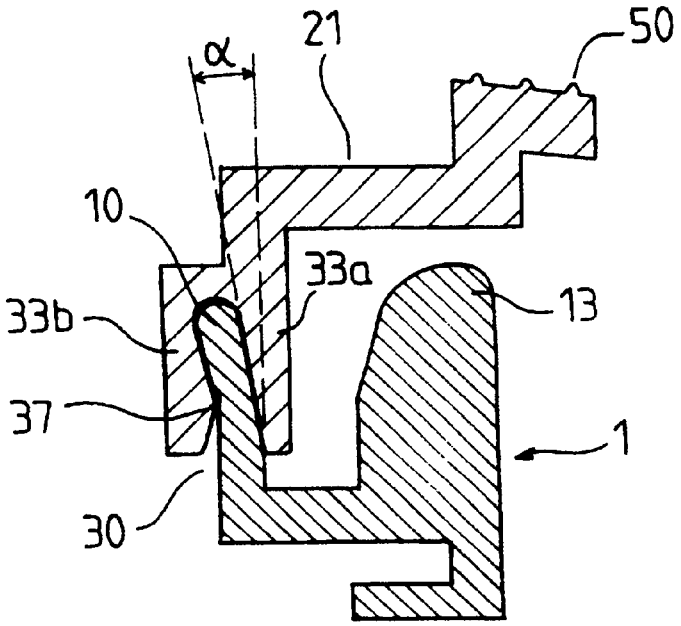
FIG. 6 is a detail and cross-sectional view of the profiles of the ring and of the flange after connection.

According to a second embodiment, the maintenance of these two parts is assured by a groove and a solid profile, the profile of the two contours 10, 30 being modified, in order to assure this function, as indicated in FIG. 6. This shows, in a transverse cross-section of the two parts 1, 21, at the level of a protrusion, the two profiles of contours 10, 30. Thus, lips 33*a*, 33*b* defining groove 31 of the U-shaped profile of ring 21 are inclined at an angle $\alpha$, sealing lip 33*b* being provided with a boss 37. Moreover, contour 30 has a form complementary to groove 31. During connection, the introduction along angle $\alpha$ of contour 10 in groove 31 permits the maintenance of the two parts by elastic deformation of lip 33*b*. In effect, by the pressure of the ring on the flange, pressure exerted by the user, contour 10 will elastically spread the U-shaped profile of contour 30, and more particularly sealing lip 33*b* by its boss 37 so that contour 10 can come to lodge at the bottom of groove 31, the elastic return of the U-shaped profile by coincidence of the complementary profiles of lip 33*b* and of contour 10 permitting maintenance of the two parts on one another, the effect being accentuated by the inclination angle $\alpha$.

According to a particular embodiment of the part intended to be connected to the bag, this comprises, on said face connected to the bag, a nonplanar crown 42, the curvature presented by the latter corresponding to its development on a rotating drum by cementing or by ultrasound, as described in Patent No. 97/12729. This crown can advantageously comprise energy vectors 50 facilitating welding of the bag by ultrasound.

According to the invention, crown 42, flat or curved, presents a contact surface with the bag of at least 5 $cm^2$, and preferably close to 10 $cm^2$, in order to insure a good seal at the level of the bag, as well as an efficient holding of the bag even when this latter is filled with dense waste products, such as a liquid. In the example presented, the internal diameter of crown 42 is 5.3 cm and the external diameter is 6.4 cm.

The principle of connection is the following. The user having connected flange 1 to the vacuum cleaner housing, for example, by the intermediary of a linerboard on which the flange is cemented by its flat contact crown 2, and wishing to connect a vacuum cleaner bag furnished with ring 21, he moves ring 21 towards flange 1 with the aid of the visual marks which are the protrusions 4, 24, i.e. by attempting to bring in juxtaposition ring 21 on flange 1 by causing the protrusions 24 to coincide with the protrusions 4 of the flange.

Depending on the maintaining device utilized, the user has available a symmetry of the order 4, i.e. he can bring any protrusion 24 toward one of the protrusions 4 of flange 1, or of a symmetry of order 2, when the device with clips 15 is utilized, in which case, it is necessary to be careful to dispose clips 15 opposite rings 35. Having brought ring 21 in contact on flange 1, the user no longer has a visual reference obstructed as it is by the dust bag. However, protrusions 4 of flange 1 are zones of small height, i.e. the immediate contour of these protrusions is a slope 6, as is visible in FIG. 3.

Thus, if the user has visually positioned ring 21 on flange 1 poorly, by effectuating slight trial and error movements, due to the presence of slopes 6, the ring will naturally be led to slide on these slopes and correctly position ring 21 on flange 1, the ring and the flange presenting a complementary form.

Maintenance of the two parts on one another is then achieved, either with the aid of a device with clips 15, or directly by the profiles of modified contours 10, 30. In the two cases, the maintenance of the two parts against one another is effectuated by pressure of the two parts on one another as has already been explained when the two parts have a modified contour 10, 30. In this case, it is however necessary to note an advantageous beneficial effect. When the user wishes to disconnect the two parts 1,21, for example to change the dust bag, he grips ring 21 which he pulls, in a natural manner along one of its protrusions 24. This provokes a separation of lip 33*b* and thus permits the separation of ring 21 of flange 1 at the level of this protrusion 24. The user performs this same separation operation for each of the other protrusions 24. The disconnection thus takes place by performing several local disconnections, which has for its overall effect to conserve the connection of flange 1 on the housing or the removable support of the vacuum cleaner, often achieved by cementing and thus fragile in the face of substantial pulling forces.

When the maintenance device comprises clips 15 and rings 35, the connection is even simpler. In effect, the exterior part of ring 35, during connection, comes to abut on the slope of hook 19 of clip 15. This being connected uniquely by its base to flange 1, it has a certain transverse flexibility which permits rings 35 of ring 21, when this latter is pressed against flange 1, to be engaged on the slopes of hooks 19 until these rings have passed beyond hooks 19. In this case the elasticity of clips 15 permits them to assume their original form and to lock rings 35 by resting on hooks 19. Disconnection of the ring and the flange is achieved with the aid of releasing organs 18 which need only be pressed radially in order to permit rings 35 to disengage from hooks 19, which is moreover hygienic since there is no direct contact with the dust bag.

Thus, as is illustrated in FIG. 8, a vacuum cleaner dust bag 52 arranged by cementing or welding onto a ring 21 is connected to flange 1, which flange being itself cemented onto a linerboard 54 by its flat crown 2, peripheral to the central opening. Of course, an entirely different support such as a removable support of the vacuum cleaner housing, or even the vacuum cleaner housing itself can be utilized to cement the flange without departing from the spirit of the invention. On this figure is equally presented the connected suction tube 56, thus in communication with the interior of dust bag 52.

It is entirely invisionable, in other variants of the general embodiment of the invention, to utilize another device for maintenance of the flange to the vacuum cleaner housing or to a removable part of the vacuum cleaner. Thus, some examples of fastening means are presented in FIGS. 9 and 10.

Figure 9A:
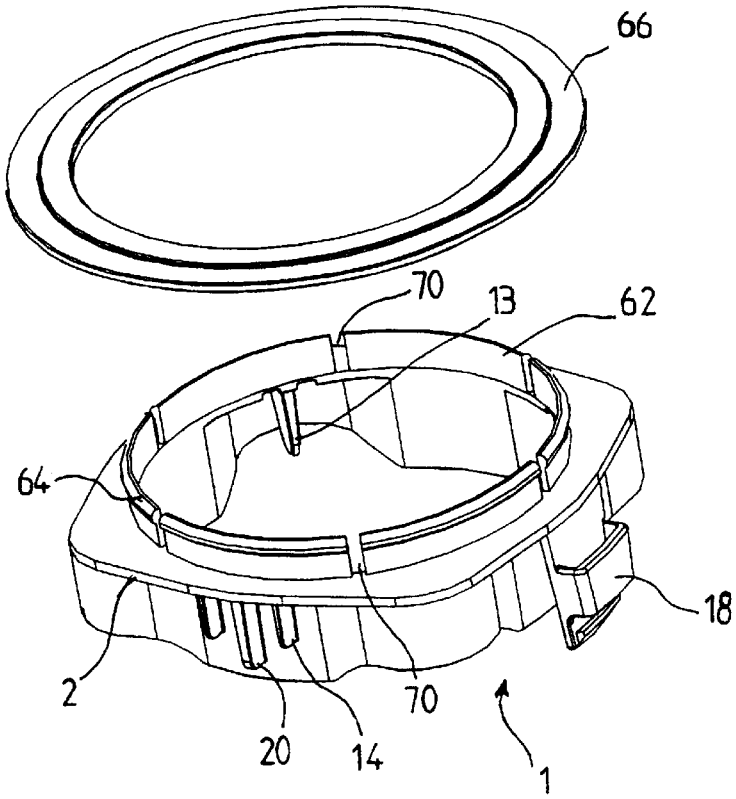
FIGS. 9*a* and 9*b* present a variant of the device for maintaining the flange on the vacuum cleaner housing or on a removable support or to a linerboard.
Figure 9B:
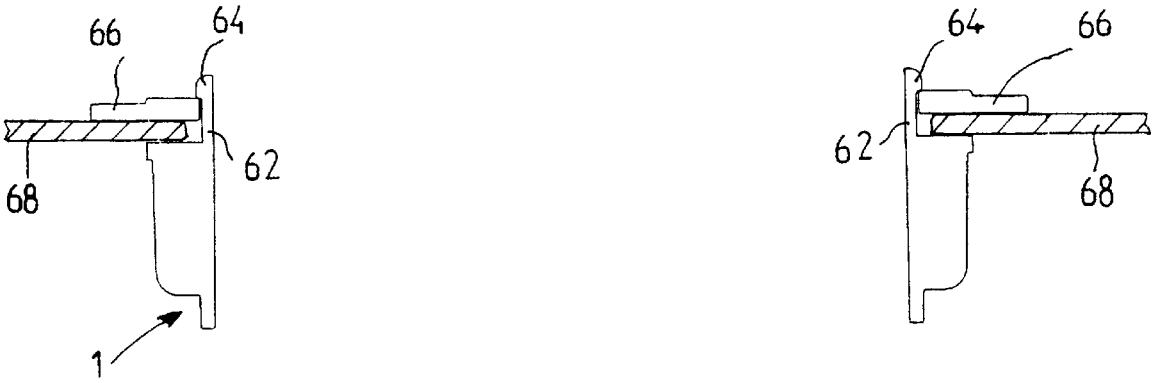

According to a first embodiment presented in FIGS. 9*a* and 9*b*, flange 1 comprises a tubular wall 62 prolonging the central opening of the flange in the direction opposed to releasing organs 18, i.e., toward the rear of the flange, if one considers that ring 21 is fixed on the front of flange 1.

This tubular wall 62 presents a bulge 64 at its extremity directed toward the exterior of the central opening of the flange in order to be able to cooperate with a disc 66 of which the diameter d of its opening is slightly less than the maximum diameter of circular wall 62, taken at the level of bulge 64.

Thus, the manner of fastening on the vacuum cleaner housing or on a removable part thereof or a linerboard is achieved in the following manner: tubular wall 62 of flange 1 is introduced into the opening of the housing or into that of the removable support or of the linerboard, represented by the part 68. Then, disc 66 is positioned around wall 62, from the other side of the flange, with respect to the part 68. Disc 66 thus acts in a certain manner as a counter-flange. The elasticity of wall 62 accentuated by notches 70, permits disc 66 to cross bulge 64, then, by return of wall 62 into its original position to maintain flange 1 against part 68.

It is to be noted that the opening in the housing or a removable part thereof or a linerboard can be slightly greater than the diameter of the opening of the connection device, as is moreover presented in FIG. 9*b*, disc 66 having a contact surface permitting this difference in diameter to be overcome.

Figure 10:
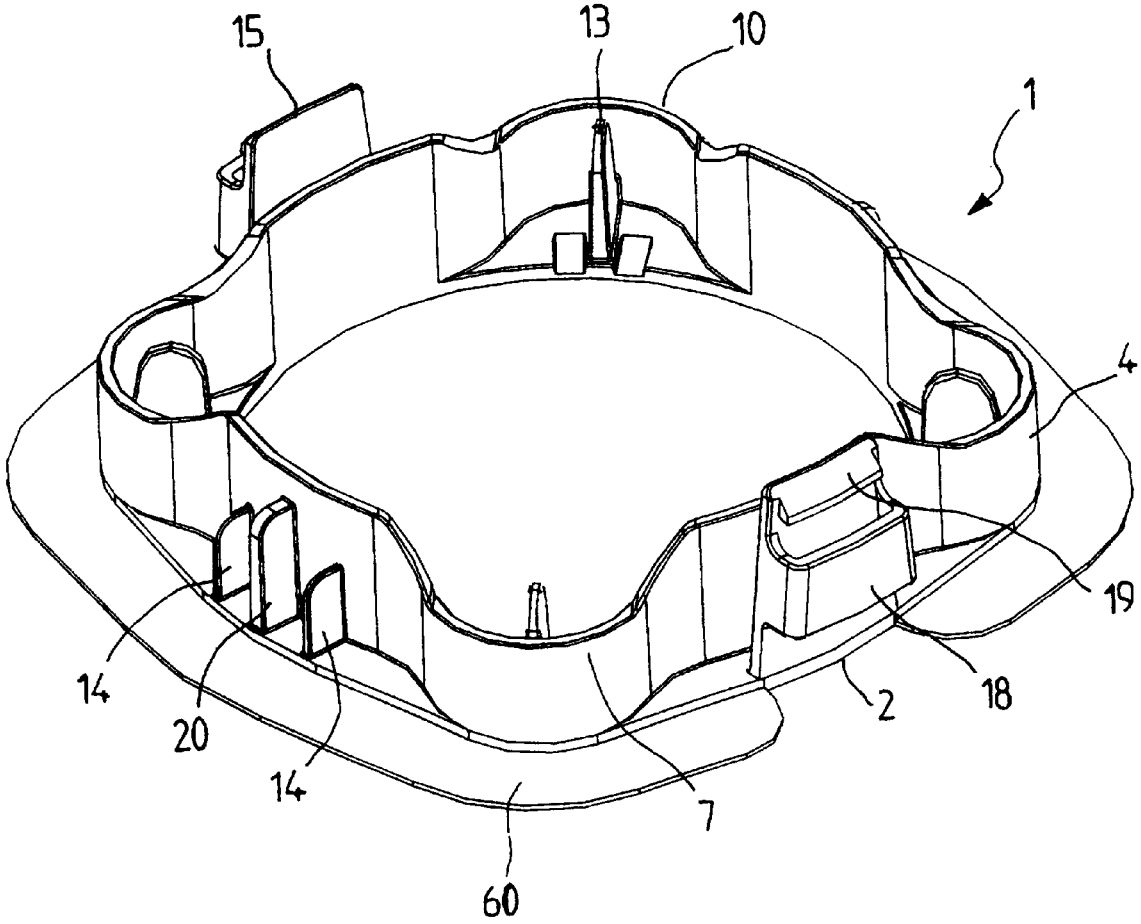
FIG. 10 presents another variant of the device for maintaining the flange on the vacuum cleaner housing or on a movable support or on a linerboard.

FIG. 10 presents another variant of fastening the flange on a removable support of the housing or on a linerboard, by a fastening system.

For this purpose, flat contact crown 2 peripheral to the central opening of flange 1 extends in a radial manner toward the exterior of the flange, thus presenting a fastening surface 60 surrounding flange 1. This surface is of small thickness, sufficiently rigid to withstand reasonable mechanical stresses, linked to the manipulation of ring 21 on flange 1 and sufficiently thin to be able to be fixed on a removable support of the housing or on a linerboard with the aid of staples passing through the thickness of surface 60 and the thickness of the support.

Thus, the present invention permits connecting vacuum cleaner bag 52 comprising a connecting element, to a vacuum cleaner or a removable part of the vacuum cleaner or to a linerboard, said connecting element of the bag being one of the two parts 1, 21 of the connection device according to one of the embodiments described in the present document.

POSSIBILITY OF INDUSTRIAL APPLICATION

The invention finds its application in the field of household vacuum cleaners and more particularly in that of vacuum cleaner dust bags.

What is claimed is:

1. Device for connecting a dust bag (52) to a vacuum cleaner, said device comprising two parts, each of said parts having an attachment face and a free face, one of said parts being a flange (1) and the other of said parts being a ring (21), one of said parts being structurally separate from, and being capable of being fixed, in a complementary manner, via its attachment face, to a vacuum cleaner housing, or a removable vacuum cleaner support, or a linerboard (54), and the other one of said parts being capable of being fixed, via its attachment face, to the dust bag (52), said flange (1) and ring (21) having complementary means for mutual connection together by their free faces, and at least one of said parts having at least one visual mark (4, 24) to facilitate connection together of said two parts, said device has a diameter that is greater than twice the length of the assembled device, when the ring (21) and the flange (1) are mutually connected together.

2. Device for connecting a dust bag (52) according to claim 1, characterized in that the flange (1) or the ring (21), capable of being fixed to a part of a vacuum cleaner housing, or to a part of a removable vacuum cleaner support, or to a linerboard, comprises, correspondingly, a peripheral contact crown (2) at its opening.

3. Device for connecting a dust bag (52) according to the claim 2, characterized in that the contact crown (2) has a surface capable of being in contact with a part of a vacuum cleaner housing, or a part of a removable vacuum cleaner support, or a linerboard, greater than 8 $cm^2$.

4. Device for connecting a dust bag (52) according to claim 2, characterized in that the means for fastening the peripheral contact crown (2) at the opening of the flange (or of the ring) on the part of the vacuum cleaner housing, or on the part of a removable vacuum cleaner support, or on the linerboard, comprises cement.

5. Device for connecting a dust bag (52) according to claim 2, characterized in that the peripheral contact crown (2) at the opening of the flange (or of the ring) presents a peripheral flat radial part (60) of small thickness having two free opposed faces in order to permit its fastening by stapling of this peripheral surface (60) on the part of the vacuum cleaner housing, or on the part of a removable vacuum cleaner support, or on the linerboard.

6. Device for connecting a dust bag (52) according to claim 2, characterized in that means for fastening the peripheral contact crown (2) to the opening of the flange (or of the ring) comprises a tubular wall (62) oriented substantially coaxially to the contact crown (2), extending said opening from the side opposed to the connection, said tubular wall comprising at its free end a bulge (64) oriented from the exterior side of the wall, so as to be able to cooperate with the internal wall of a disc (66) serving as a counter piece when the flange (or the ring) is inserted, by the tubular wall, in the opening of the wall (68) of the vacuum cleaner housing, or of a part of a removable vacuum cleaner support, or of a linerboard.

7. Device for connecting a dust bag (52) according to claim 1, characterized in that the ring (21) (or the flange (1)), capable of being fixed to the vacuum cleaner bag, comprises, correspondingly, a peripheral fastening contact crown (42) at its opening.

8. Device for connecting a dust bag (52) according to the claim 7, characterized in that the surface of the contact crown with the vacuum cleaner bag is greater than 5 $cm^2$.

9. Device for connecting a dust bag (52) according to claim 7, characterized in that the fastening means of the peripheral contact crown at the opening of the ring (21) (or of the flange (1)) on the dust bag comprises cement.

10. Device for connecting a dust bag (52) according to claim 7, characterized in that the fastening means of the peripheral contact crown at the opening of the ring (21) or of the flange (1) on the dust bag is an ultrasonic weld.

11. Device for connecting a dust bag (52) according to claim 1, characterized in that the flange (1) and the ring (21) have a nonplanar surface at the level of their free face, facing one another, obtained by variation of the height of the two parts, in order to guide one of the parts on the other at the moment of their connection.

12. Device for connecting a dust bag (52) according to claim 11, characterized in that each of the two parts is provided with a plurality of lateral protrusions and with zones of small height (7,28) and said zones of small height are situated:

on one of the two parts (1,21) at the level of the lateral protrusions on the one part (4,24), and between the lateral protrusions (24,4) on the other part (1, 21).

13. Device for connecting a dust bag (52) according to claim 11, characterized in that the flange (1) and the ring (21) have the same number of protrusions (4, 24).

14. Device for connecting a dust bag (52) according to claim 1, characterized in that the visual marks of the flange (1) and of the ring (21) are at least one lateral protrusion (4, 24) provided in each of the two parts.

15. Device for connecting a dust bag (52) according to claim 1, characterized in that it comprises, on the ring (21) and on the flange (1), at least two protrusions (4, 24) disposed in a symmetrical manner on each of the parts (1, 21).

16. Device for connecting a dust bag (52) according to claim 1, characterized in that the free surface of one of the two parts (1, 21), comprises a contour (30) profiled in the form of a U having a sealing lip (33*b*) comprising an internal boss (37) and a guide lip (33*a*), these two lips defining a groove (31) capable of receiving, in a complementary manner, the profile of the contour (10) of the free surface of the other piece (21, 1) in order to create a sealed assembly.

17. Device for connecting a dust bag (52) according to claim 1, characterized in that the complementary means for mutual maintenance of the ring (21) and of the flange (1) are constituted by at least one clip (15) formed on one of the two parts (1, 21), the second part (21, 1) having at least one complementary ring (35) capable of cooperating with the clip (15) in order to create the maintenance device.

18. Device for connecting a dust bag (52) according to claim 1, characterized in that the complementary means for mutually maintaining the ring (21) and the flange (1) are constituted:

by a U-shaped profile created in one of the two parts (1, 21) and having a guide lip (33*a*) and a sealing lip (33*b*) defining a groove (31) inclined at an angle $\alpha$, the sealing lip having a boss (37), by a profile complementary to this groove (31) of the contour (10) formed in the second part (21, 1), in such a manner that the mutual maintenance of the two parts (1, 21) is produced by elastic deformation of the lip (33*b*) during engagement of the contour (10) in the groove (31).

19. A vacuum cleaner bag (52) comprising an element for attachment to a vacuum cleaner or to a removable part of the vacuum cleaner or to a linerboard (54), characterized in that said element for attachment of the bag is one of the two parts (1, 21) of the system according to claim 1.

20. Device for connecting a dust bag (52) according to claim 1 wherein said one of said parts is manufactured separately from the vacuum cleaner.

* * * * *